US008622750B2

(12) United States Patent
Balint et al.

(10) Patent No.: US 8,622,750 B2
(45) Date of Patent: Jan. 7, 2014

(54) WHITEBOARD

(75) Inventors: David Kali Alexander Balint, South Fremantle (AU); Edward Joseph Khoury, Bateman (AU)

(73) Assignee: Clearboard Pty Ltd., Fremantle, Western Australia (AU)

( * ) Notice: Subject to any disclaimer, the term of this patent is extended or adjusted under 35 U.S.C. 154(b) by 341 days.

(21) Appl. No.: 13/122,756

(22) PCT Filed: Oct. 5, 2009

(86) PCT No.: PCT/AU2009/001319

§ 371 (c)(1),
(2), (4) Date: Apr. 6, 2011

(87) PCT Pub. No.: WO2010/040172

PCT Pub. Date: Apr. 15, 2010

(65) Prior Publication Data

US 2011/0195393 A1 Aug. 11, 2011

(30) Foreign Application Priority Data

Oct. 6, 2008 (AU) ..... 2008905170

(51) Int. Cl.
*B43L 1/00* (2006.01)

(52) U.S. Cl.
USPC ..... 434/408

(58) Field of Classification Search
USPC ..... 434/408, 411, 412, 413, 428, 430; 40/361, 367, 584, 771, 776
See application file for complete search history.

(56) References Cited

U.S. PATENT DOCUMENTS

| | | | | | |
|---|---|---|---|---|---|
| 3,608,219 | A * | 9/1971 | Verebay | 40/530 |
| 4,427,387 | A * | 1/1984 | Tomita | 434/88 |
| 4,761,139 | A * | 8/1988 | Mashiach | 434/410 |
| 4,775,918 | A * | 10/1988 | Snyder | 362/18 |
| 5,324,202 | A * | 6/1994 | Meyers et al. | 434/410 |
| 5,711,523 | A * | 1/1998 | Sternberg et al. | 273/153 R |
| 6,119,380 | A * | 9/2000 | Inbar | 40/361 |
| 6,164,970 | A * | 12/2000 | Mazuryk | 434/150 |
| 6,168,291 | B1 * | 1/2001 | Rockey et al. | 362/278 |
| 6,817,124 | B1 * | 11/2004 | Ko | 40/471 |
| 7,312,914 | B2 | 12/2007 | Shinozaki et al. | |
| 2004/0221496 | A1 * | 11/2004 | Ko | 40/471 |
| 2008/0160494 | A1 * | 7/2008 | Leifer et al. | 434/408 |
| 2011/0099863 | A1 * | 5/2011 | Burtch | 40/491 |

FOREIGN PATENT DOCUMENTS

| | | | |
|---|---|---|---|
| CN | 2361481 | Y | 2/2000 |
| JP | 10268427 | A | 10/1998 |
| JP | 10336368 | A | 12/1998 |
| JP | 2007331256 | A | 12/2007 |
| KR | 1020070114238 | A | 11/2007 |

OTHER PUBLICATIONS

International Search Report dated Nov. 17, 2009 in corresponding International Patent Application No. PCT/AU2009/001319, 5 pages.

* cited by examiner

*Primary Examiner* — Kurt Fernstrom
(74) *Attorney, Agent, or Firm* — Maier & Maier, PLLC

(57) ABSTRACT

A whiteboard (10) comprising a transparent panel (12) locatable in front of a surface (18) and a screening means (14). The screening means (14) is changeable between a first state in which the view through the transparent panel (12) is unobstructed and a second state in which the screening means (14) obstructs the view through the transparent panel (12).

11 Claims, 7 Drawing Sheets

WHITEBOARD

RELATED APPLICATIONS

This application is the U.S. national stage application which claims priority under 35 U.S.C. §371 to International Patent Application No.: PCT/AU2009/001319, filed on Oct. 5, 2009, which claims priority under 35 U.S.C. §119, to Australian Patent Application No.: 20089055170, filed Oct. 6, 2008, the disclosure of which are incorporated by reference herein their entireties.

FIELD OF THE INVENTION

The present invention relates to a whiteboard.

BACKGROUND TO THE INVENTION

Whiteboards are used for presentation of information in many different locations. In some locations, for example corporate board rooms, the permanent mounting of a whiteboard to a wall of the room may detract from the appearance of the room. One possible solution in such circumstances is to use a mobile whiteboard which can be stored when not in use. This however results in the inconvenience of having to move the whiteboard in and out of position and requiring also a suitable space to store the whiteboard when not in use.

The present invention relates to a whiteboard which attempts to overcome, at least in part, the abovementioned problems.

SUMMARY OF THE INVENTION

According to one aspect of the present invention there is provided a whiteboard comprising a transparent panel locatable in front of a surface and a screening means, wherein the screening means comprises a blind windable onto a reel such that in a first state the blind is wound onto the reel and in a second state the blind is extended from the reel to be adjacent the transparent panel.

Preferably the reel is securable adjacent an upper edge of the transparent panel and in the second state the blind is located adjacent to the transparent panel between the transparent panel and the surface on which the transparent panel is mounted. Further, the reel is preferably mounted within a housing secured to the upper edge of the transparent panel.

Preferably a plurality of spacers are provided around edges of the transparent panel such that the transparent panel is held away from and parallel to the surface by the spacers. In one embodiment, the spacers are provided secured to the lower edge of the transparent panel at opposite ends of the lower edge and the housing is secured along the length of the upper edge and is securable to the surface such that the transparent panel is held away from and parallel to the surface.

A front longitudinal edge of the housing may be provided with a recess such that an upper edge of the transparent panel is received into the recess.

In one embodiment, the housing comprises a generally U-shaped elongate member arranged such that an open side thereof is positioned lowermost and a pair of end caps are secured across each longitudinal end of the elongate member. The reel is preferably secured between protrusions provided on inner surfaces of the end caps such that the reel can turn, allowing the blind to be pulled downwardly from the lower open side of the housing.

Preferably a mounting rail is provided, the mounting rail comprising an elongate member having an upward facing groove such that a rear longitudinal edge of the housing can be received downwardly in the groove.

A guide member may be provided extending between the end caps below the reel and adjacent the upper edge of the transparent panel, the guide member including an angled wall having an upper edge generally tangential to the reel and a lower edge generally parallel to the transparent panel such that the blind slides over the angled wall when extending to the second state thereof.

In one embodiment, one or more lights is provided within the housing to backlight the blind or to illuminate the surface behind the transparent panel.

A sensor may be provided to detect the position of the screening means and switch the lights on or off based on the detected position of the screening means.

In an alternative embodiment, the transparent panel comprises a panel of smart glass switchable between a clear and an opaque state.

BRIEF DESCRIPTION OF THE DRAWINGS

The invention will now be described, by way of example, with reference to the following drawings in which.

DETAILED DESCRIPTION OF PREFERRED EMBODIMENTS

Figure 1:
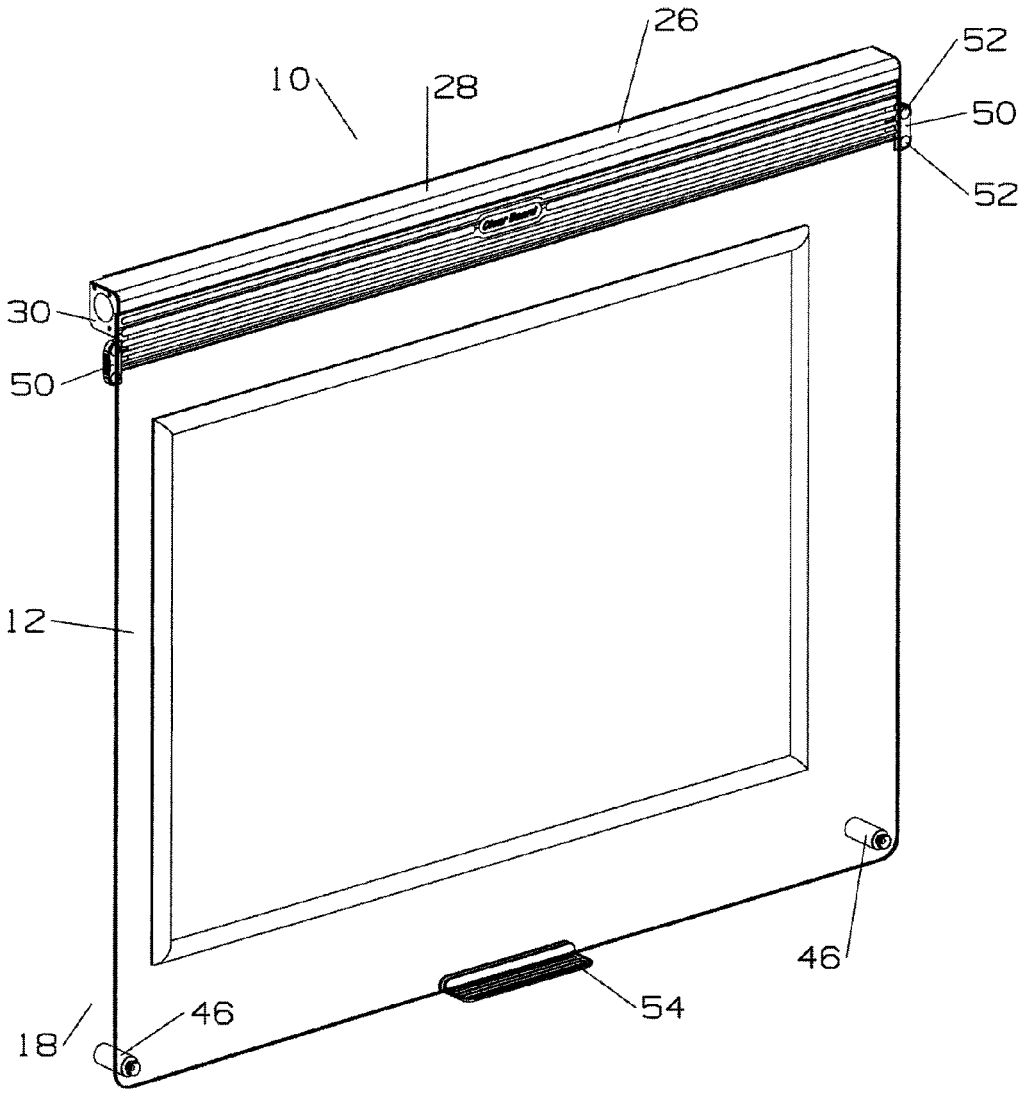
FIG. 1 is a perspective view of a whiteboard in accordance with the present invention with the blind in a retracted position.
Figure 2:
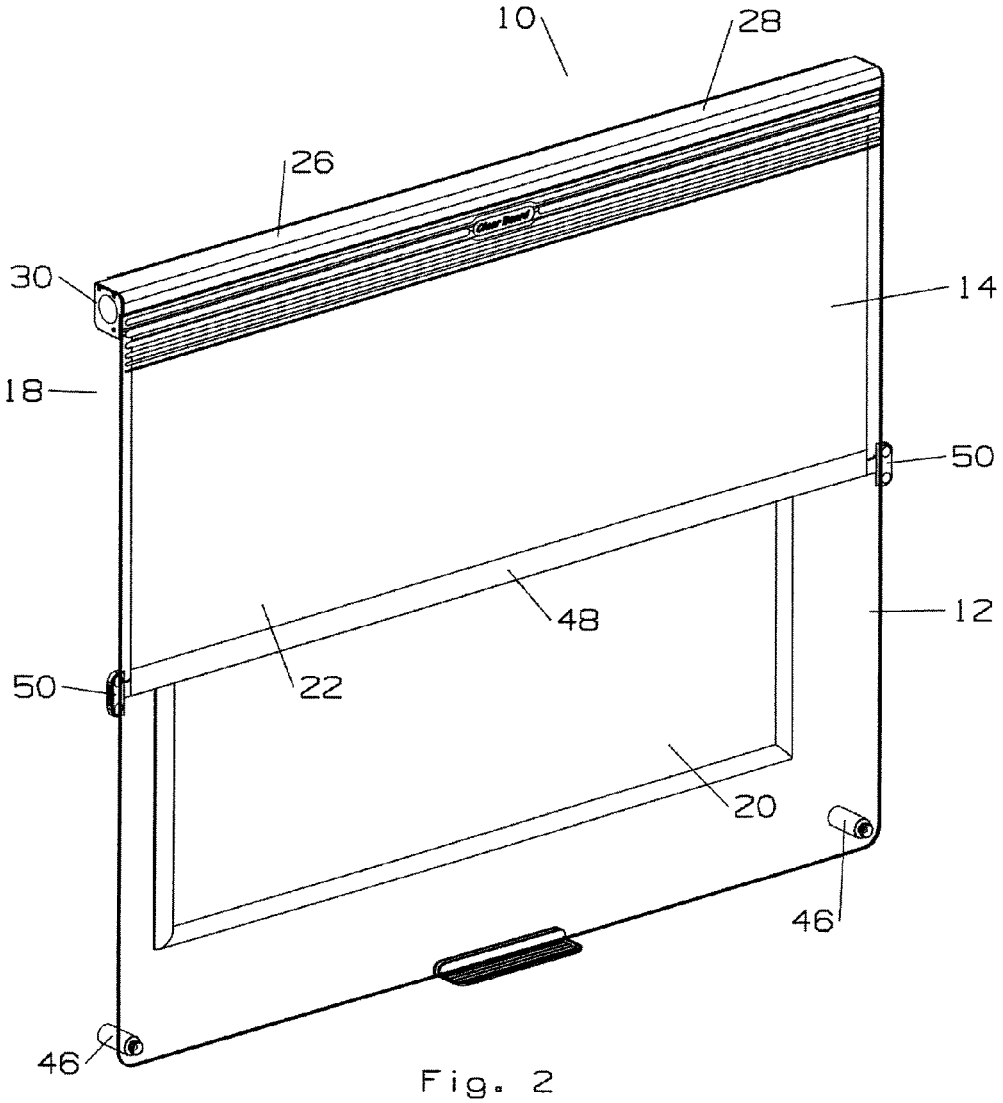
FIG. 2 is a perspective view of the whiteboard of FIG. 1 with the blind in a partially extended position.

Referring to the Figures there is shown a whiteboard 10 comprising a transparent panel 12 and a screening means 14. In the embodiment shown, the transparent panel 12 comprises a glass panel. The transparent panel 12 may alternatively be constructed of any suitable clear material, such as a transparent plastic.

The transparent panel 12 is locatable in front of a surface such that the transparent panel 12 is positioned generally parallel to the surface. In the embodiment shown, the surface comprises a wall 18 and the transparent panel 12 is mountable in front of the wall 18 such that a space is defined between the transparent panel 12 and the wall 18.

The screening means is changeable between a first state and a second state. In the first state, the screening means does not obstruct the passage of light from the wall 18 through the transparent panel 12. That is, the wall 18 behind the transparent panel 12, or any item in front of the wall 18, can be viewed through the transparent panel 12. When the screening means 14 is in the first state, the whiteboard 10 is in a non-use state. In the embodiment shown in the Figures, the transparent panel 12 is positioned on the wall 18 in front of a picture 20 mounted on the wall 18. In the non-use state, the picture 20 can therefore be viewed through the transparent panel 12.

When in the second state, the screening means 14 obstructs the passage of light from the wall 18 through the transparent panel 12. That is, the wall cannot be viewed through the transparent panel 12. When the screening means 14 is in the second state, the whiteboard 10 is in the "in use" state.

The transparent panel 12 is provided with a plurality of spacers 46 around the edge thereof such that the transparent panel 12 is held away from and parallel to the wall 18 by the spacers 46. In the embodiment shown, spacers 46 are provided secured to the lower edge of the transparent panel 12 at opposite ends of the lower edge.

In the embodiment shown in the Figures, the screening means comprises a blind 22 windable onto a reel 24. The reel 24 is mounted within a housing 26 secured in use adjacent an upper edge of the transparent panel 12. The housing 26 is secured along the length of the upper edge and is securable to the wall 18 such that the upper edge is held away from the wall 18.

Figure 3:
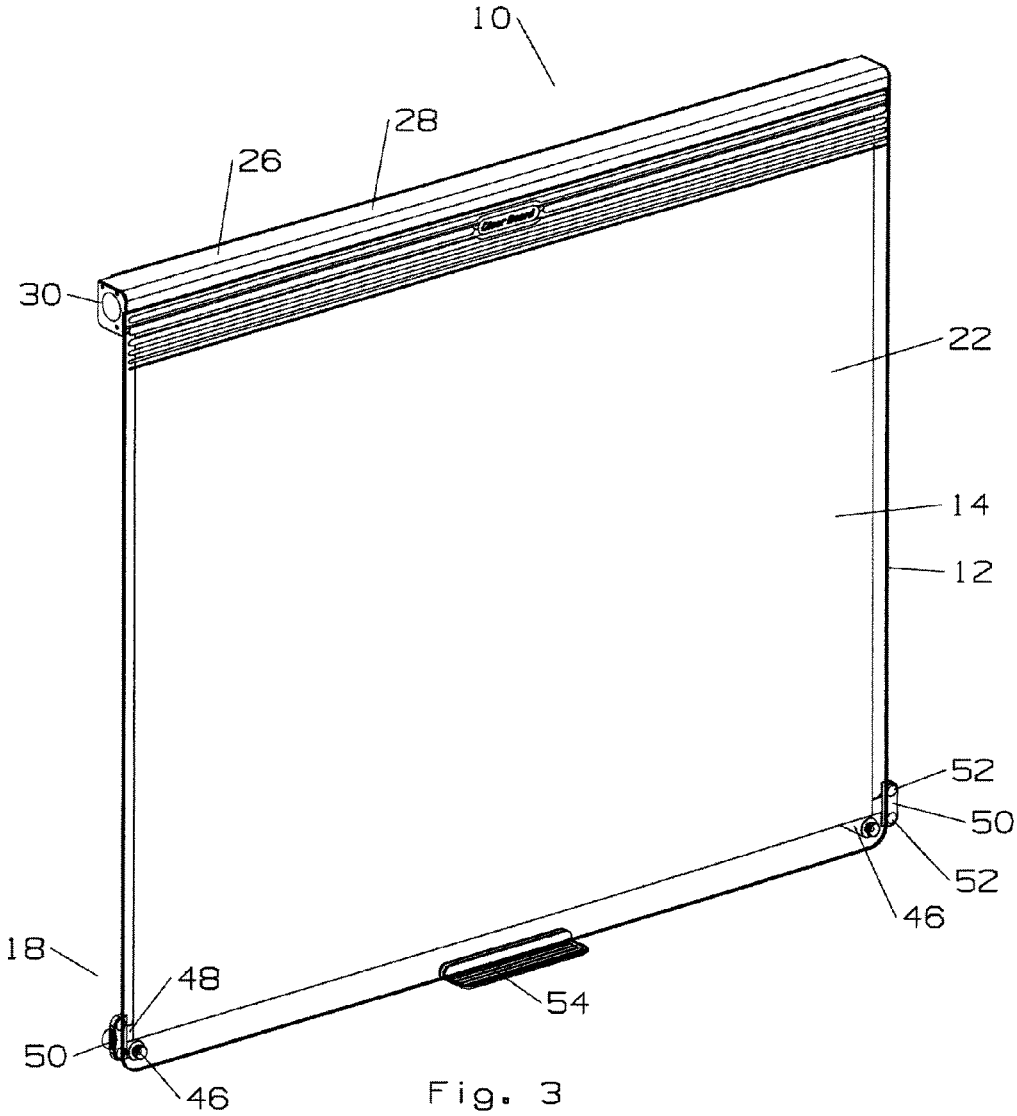
FIG. 3 is a perspective view of the whiteboard of FIG. 1 with the blind in a fully extended position.
Figure 4:
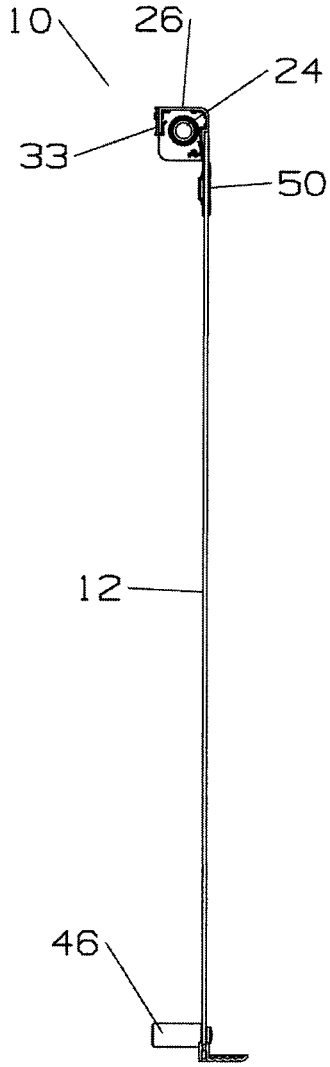
FIG. 4 is a side view of the whiteboard in the position of FIG. 1.
Figure 5:
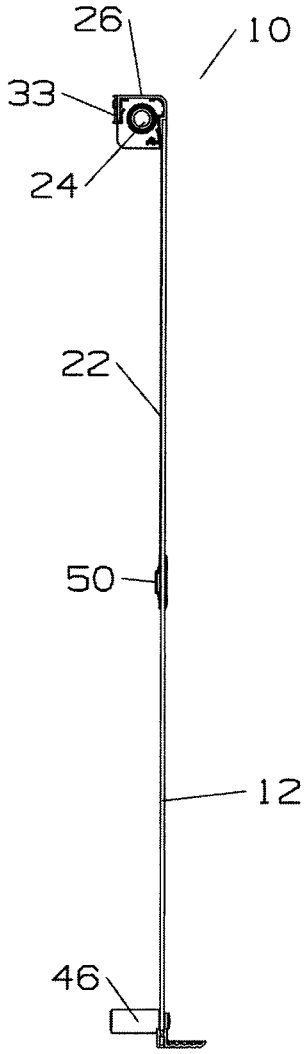
FIG. 5 is a side view of the whiteboard in the position of FIG. 2.
Figure 6:
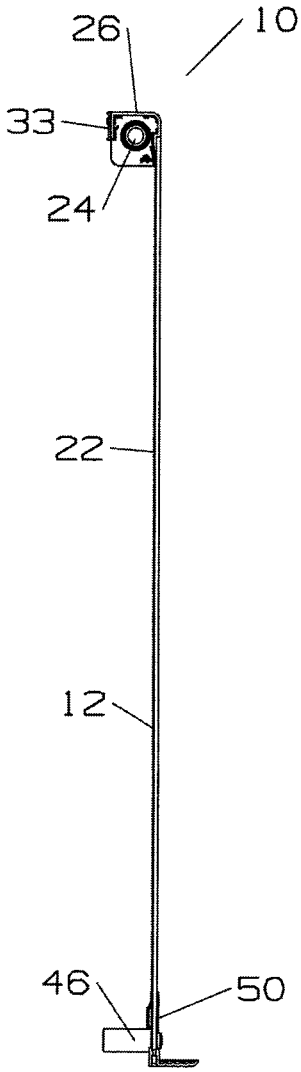
FIG. 6 is a side view of the whiteboard in the position of FIG. 3.
Figure 7:
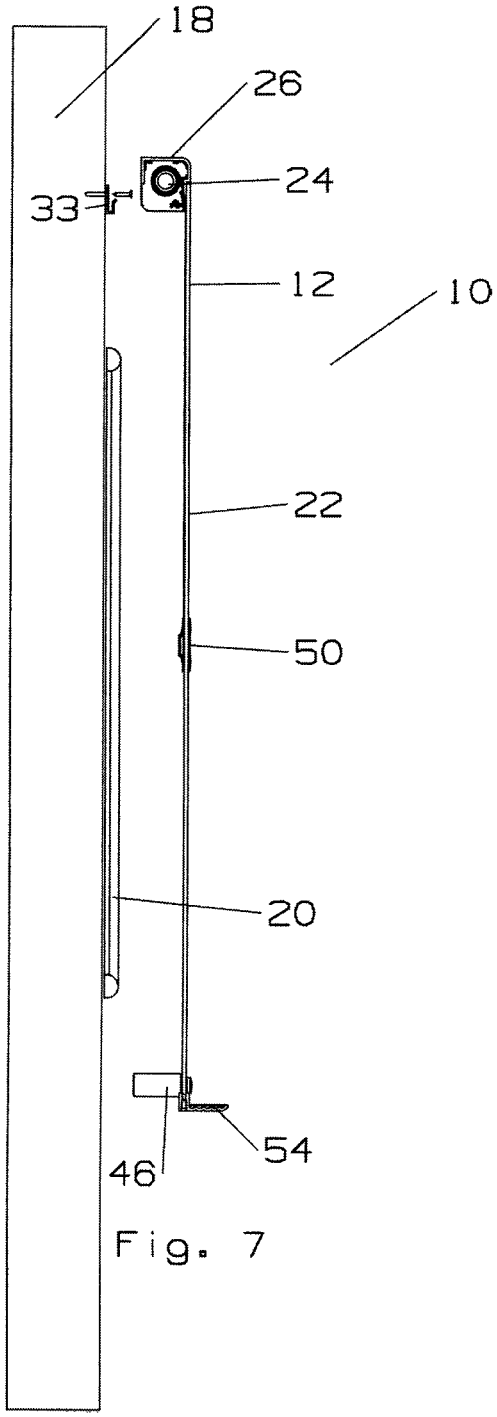
FIG. 7 is a side view of the whiteboard of FIG. 1 prior to fixing to a wall on which a picture frame is mounted.

The blind 22 is preferably opaque and white in colour. In the first state (as shown in FIGS. 1 and 4), the blind 22 is wound onto the reel 24 so that the blind is entirely contained within the housing 26. In the second state (as shown in FIGS. 3 and 6), the blind 22 is extended downwardly such that the blind 22 is adjacent to and behind the transparent panel 12. The blind 22 extends through an opening in a lower side of the housing 26. When in the second state, the transparent panel 12 therefore appears white and can be used as a whiteboard.

Figure 8:
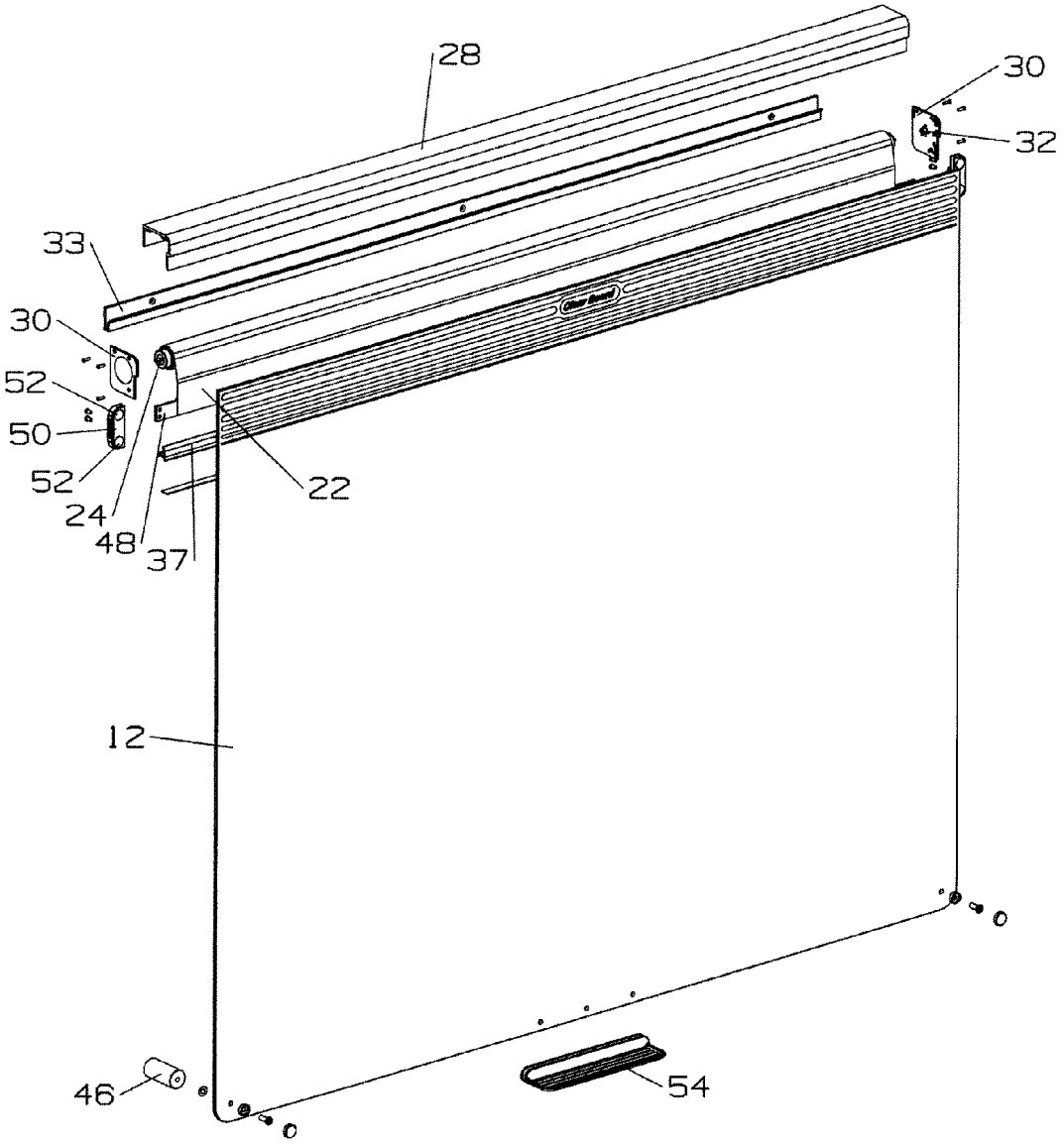
FIG. 8 is an exploded view of the whiteboard of FIG. 1.
Figure 9:
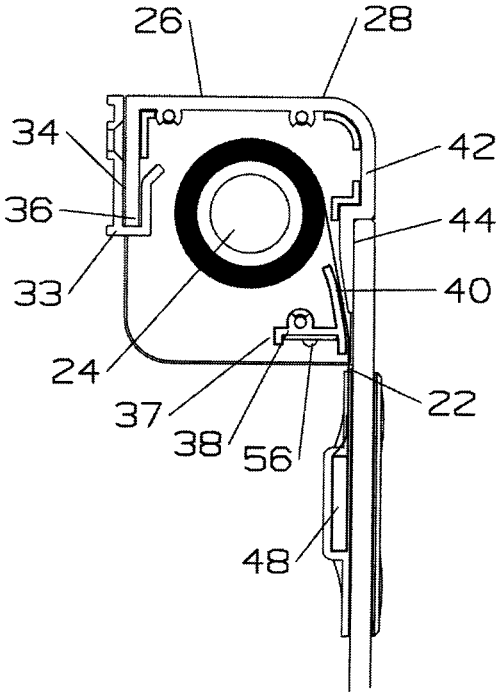
FIG. 9 is a side cross sectional view of the blind housing of the whiteboard of FIG. 1.

FIGS. 8 and 9 show the components of the housing 26 of the whiteboard 10. The housing 26 comprises a hollow elongate member having the opening in the lower side thereof. In the embodiment shown, the hollow elongate member is formed from a generally U-shaped extrusion 28 arranged such that the open side is positioned lowermost and a pair of end caps 30 are secured across each longitudinal end of the extrusion 28. The reel 24 is secured between protrusions 32 provided on inner surfaces of the end caps 30 such that the reel 24 can turn, allowing the blind 22 to be pulled downwardly from the lower open side of the housing 26.

Also provided is a mounting rail 33. The mounting rail 33 comprises an elongate plate generally J-shaped in cross section (as can be seen in FIG. 9) such that an upward facing groove 34 is defined. The mounting rail 33 is secured to the wall 18 and a rear longitudinal edge 36 of the housing 26 can be received downwardly in the groove 34 such that the housing 26 hangs from the mounting rail 33.

The housing 26 is also provided with a guide member 37. The guide member 37 comprises an extrusion extending between the end caps 30 below the reel 24 and adjacent the upper edge of the transparent panel 12. The guide member 37 includes a horizontal section 38 and an angled wall 40. The angled wall 40 extends from an edge of the horizontal section 38 and is curved such that an upper edge is generally tangential to the reel 24 and a lower edge is generally parallel to the transparent panel 12. The blind 22 slides over a surface of the angled wall 40 as can be seen in FIG. 9.

The front longitudinal edge 42 of the housing 26 is provided with a recess 44 such that an upper edge of the transparent panel 12 is secured into the recess 44.

A lower edge of the blind 22 is provided with a support rod 48. Ends of the support rod 48 are slidably connected to vertical edges of the transparent panel 12. Each end of the support rod 48 is provided with a roller member 50. The roller members 50 each include a pair of rollers 52 positioned such that the rollers 52 engage with the vertical edge of the transparent panel 12. By gripping one or both of the roller members 50 and sliding the roller members 50 downwardly, the support rod 48 and hence the lower edge of the blind 22 can be moved down into the second state thereof. The reel 24 is preferably of a known spring loaded type which can retract the blind 22. To move the blind 22 back to the first state thereof, the roller members 50 are pulled briefly downwardly and released to allow the spring mechanism to retract the blind 22.

Figure 10:
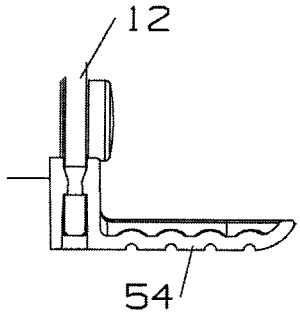
FIG. 10 is a side cross sectional view of a lower shelf of the whiteboard of FIG. 1.

The transparent panel 12 may also be provided with a shelf 54. The shelf 54 is connected to the lower edge of the transparent panel 12 as shown in FIG. 10 and can be used to store whiteboard implements such as markers and erasers. The shelf 54 may be pivotally connected to the lower edge of the transparent panel 12 such that it can be pivoted between a horizontal position and a vertical position. In the vertical position the shelf 54 is located adjacent and parallel to the transparent panel. A lower surface of the shelf 54 may be provided with a label holder (not shown) such that the label holder can be used to display information about the picture located behind the transparent panel 12 when the whiteboard 10 is in the non-use state.

Further, one or more lights may be incorporated in the whiteboard 10. The lights may be provided to backlight the blind 22 to provide better illumination for use as a whiteboard. In this case, the blind 22 may be constructed of a material such that it is not completely opaque in order for some light to pass through the blind 22, thereby backlighting the whiteboard 10 in the second state.

The lights may also be provided to light the picture 20 behind the transparent panel 12 when not in use as a whiteboard 10. The lights may be contained in a strip of lights 56 secured to the underside of the horizontal section 38 of the guide member 37. A sensor may also be provided to detect the position of the screening means and switch on or off the lights automatically based on the detected position of the screening means 14. The sensor may be used to turn on the light when the blind is in the second state thereof for backlighting the whiteboard in the in-use state, or may turn on the light when the blind 22 is in the non-use state in order to light the picture behind the transparent panel 12.

In use, the whiteboard can be positioned in a location such as over a picture frame 20 as shown in the Figures. The arrangement of the transparent panel 12 supported from the wall 18 in front of the picture frame 20 by the spacers 46 gives the appearance of the transparent panel 12 being used as a protective cover for the picture frame 20. The whiteboard 10 when not in use therefore does not obviously appear as a whiteboard and does not detract from the appearance of the area in which it is mounted.

In a further embodiment of the invention, a motor may be provided to drive the reel 24 such that the blind 22 can be moved between the first and second positions thereof.

It will be appreciated that the whiteboard 10 may be positioned in another suitable position such that when in the non-use state, the view through the whiteboard 10 is unobstructed. The whiteboard 10 can then be used when desired by moving the screening means 14 to the in use state. The whiteboard 10 may, for example, be positioned in front of a window, rather than in front of a picture 20.

In an alternative embodiment, the transparent panel 12 which forms part of the whiteboard 10 may also be used as part of a picture frame. That is, the transparent panel 12 may include means to hold a picture such that the blind 22 can be pulled down between the picture and the transparent panel 12. Also, in another embodiment, the transparent panel 12 may itself form part of a window structure. For example, the transparent panel 12 may comprise the inner pane of a double glazed window, with the blind 22 slidable down between the two panes of glass.

In a further embodiment, the screening means 14 may comprise a mechanism other than a blind slidable downwardly to obstruct the view through the transparent panel 12. For example, the transparent panel 12 may be constructed of 'Smartglass' such that applying or removing a current switches the transparent panel 12 between the first state in which the glass is clear and the second state in which the view through the panel is obstructed.

It will be appreciated that the whiteboard of the present invention may also be used for other purposes in which an opaque screen is required, such as a projector screen.

It will be readily apparent to persons skilled in the relevant arts that various modifications and improvements may be made to the foregoing embodiments, in addition to those already described, without departing from the basic inventive concepts of the present invention.

The invention claimed is:

1. A whiteboard comprising:

an elongate housing mountable to a surface;

a transparent panel having a plurality of spacers provided adjacent a lower edge and being secured to the housing adjacent an upper edge such that the transparent panel is supported in front of said surface;

a blind provided on a reel within the housing such that the reel can be rotated to retract the blind onto the reel or rotated such that the blind extends downwardly through an opening in a lower side of the housing to be located adjacent the transparent panel between the transparent panel and the surface such that the view of the surface through the transparent panel is obstructed.

2. A whiteboard in accordance with claim 1, wherein the spacers are provided secured to the lower edge of the transparent panel at opposite ends of the lower edge and the housing is secured along the length of the upper edge and is securable to the surface such that the transparent panel is held away from and parallel to the surface.

3. A whiteboard in accordance with claim 2, wherein a front longitudinal edge of the housing is provided with a recess such that an upper edge of the transparent panel is received into the recess.

4. A whiteboard in accordance with claim 1, wherein the housing comprises a generally U-shaped elongate member arranged such that an open side thereof is positioned lowermost and a pair of end caps are secured across each longitudinal end of the elongate member.

5. A whiteboard in accordance with claim 4, wherein the reel is secured between protrusions provided on inner surfaces of the end caps such that the reel can turn, allowing the blind to be pulled downwardly from the lower open side of the housing.

6. A whiteboard in accordance with claim 1, wherein a mounting rail is provided, the mounting rail comprising an elongate member having an upward facing groove such that a rear longitudinal edge of the housing can be received downwardly in the groove.

7. A whiteboard in accordance with claim 4, wherein a guide member is provided extending between the end caps below the reel and adjacent the upper edge of the transparent panel, the guide member including an angled wall having an upper edge generally tangential to the reel and a lower edge generally parallel to the transparent panel such that the blind slides over the angled wall when extending to the second state thereof.

8. A whiteboard in accordance with claim 1, wherein one or more lights is provided within the housing to backlight the blind.

9. A whiteboard in accordance with claim 1, wherein one or more lights is provided in the housing to illuminate the surface behind the transparent panel.

10. A whiteboard in accordance with claim 9, wherein the lights are contained in a strip of lights secured to the underside of the guide member.

11. A whiteboard in accordance with claim 8, wherein a sensor is provided to detect the position of the blind and switch the lights on or off based on the detected position of the blind.

* * * * *